US012123177B2

(12) United States Patent
Berton

(10) Patent No.: US 12,123,177 B2
(45) Date of Patent: Oct. 22, 2024

(54) COMPOSITE TOOTH WITH FRUSTOCONICAL INSERT

(71) Applicant: Magotteaux International S.A., Vaux-sous-Chevremont (BE)

(72) Inventor: Guy Berton, Oteppe (BE)

(73) Assignee: Magotteaux International S.A., Vaux-sous-Chevremont (BE)

( * ) Notice: Subject to any disclaimer, the term of this patent is extended or adjusted under 35 U.S.C. 154(b) by 802 days.

(21) Appl. No.: 17/051,152

(22) PCT Filed: Apr. 30, 2019

(86) PCT No.: PCT/EP2019/061021
§ 371 (c)(1),
(2) Date: Oct. 27, 2020

(87) PCT Pub. No.: WO2019/211268
PCT Pub. Date: Nov. 7, 2019

(65) Prior Publication Data

US 2021/0131076 A1 May 6, 2021

(30) Foreign Application Priority Data

May 4, 2018 (EP) ..... 18170766

(51) Int. Cl.
*E02F 9/28* (2006.01)
*B22D 19/02* (2006.01)
(Continued)

(52) U.S. Cl.
CPC ..... *E02F 9/285* (2013.01); *B22D 19/02* (2013.01); *C22C 1/1036* (2013.01); *B22F 2005/001* (2013.01)

(58) Field of Classification Search
CPC ... C22C 1/1036; C22C 33/0242; C22C 1/055; E02F 9/285; B22F 2005/001; B22D 19/02; B22D 19/06; B22D 19/14
See application file for complete search history.

(56) References Cited

U.S. PATENT DOCUMENTS 3,623,849 A 8/1969 Benjamin
3,785,801 A 1/1974 Benjamin
(Continued)

FOREIGN PATENT DOCUMENTS

CN 103317122 A 9/2013
CN 106001561 A 10/2016
(Continued)

OTHER PUBLICATIONS

Jun. 21, 2019, International Search Report and Written Opinion of the International Searching Authority from the European Receiving Office in PCT/EP2019/061021, which is an international application corresponding to this U.S. application.
(Continued)

*Primary Examiner* — Adam J Behrens
*Assistant Examiner* — Blake E Scoville
(74) *Attorney, Agent, or Firm* — Kolitch Romano Dascenzo Gates LLC

(57) ABSTRACT

A composite tooth is described for working the ground or rocks. The tooth includes a ferrous alloy having a portion reinforced at least partially by an insert. The portion reinforced by the insert is configured to allow, after in-situ reaction, the obtention of an alternating macro-microstructure of millimetric areas concentrated with micrometric globular particles of titanium carbides separated by millimetric areas substantially free of micrometric globular particles of titanium carbides. The millimetric areas concentrated with micrometric globular particles of titanium
(Continued)

carbides form a microstructure in which the micrometric interstices between the globular particles are also filled by the ferrous alloy. The macro-microstructure generated by the insert is at least 2 mm, preferably at least 3 mm from a distal surface of the tooth.

14 Claims, 11 Drawing Sheets

(51) Int. Cl.
*C22C 1/10* (2023.01)
*B22F 5/00* (2006.01)

(56) References Cited

U.S. PATENT DOCUMENTS

| | | | | | |
|---|---|---|---|---|---|
| 3,984,910 | A * | 10/1976 | Helton | E02F 9/285 419/48 |
| 4,119,459 | A | 10/1978 | Ekemar | |
| 4,626,464 | A | 12/1986 | Jachowski | |
| 5,066,546 | A | 11/1991 | Materkowski | |
| 5,081,774 | A * | 1/1992 | Kuwano | E02F 9/285 428/614 |
| 5,337,801 | A | 8/1994 | Materkowski | |
| 5,785,109 | A * | 7/1998 | Hongawa | B22D 19/14 164/112 |
| 8,646,192 | B2 * | 2/2014 | Berton | C22C 33/0242 37/460 |
| 8,763,282 | B2 * | 7/2014 | Brufau Guinovart | C22C 33/0242 37/460 |
| 8,999,518 | B2 | 4/2015 | Vescera | |
| 2006/0118265 | A1 | 6/2006 | Poncin | |
| 2008/0102300 | A1 | 5/2008 | Bhide | |
| 2011/0226882 | A1 | 9/2011 | Berton | |
| 2011/0303778 | A1 | 12/2011 | Berton | |
| 2012/0003488 | A1 | 1/2012 | Kirk | |
| 2012/0131821 | A1 * | 5/2012 | Brufau Guinovart | E02F 3/8152 37/452 |
| 2017/0233986 | A1 * | 8/2017 | Yaniak | E02F 9/285 37/452 |
| 2018/0369905 | A1 | 12/2018 | Olejnik | |
| 2020/0384580 | A1 | 12/2020 | Zheng | |

FOREIGN PATENT DOCUMENTS

| | | | | |
|---|---|---|---|---|
| CN | 108212338 | A | 6/2018 | |
| CN | 108380850 | A | 8/2018 | |
| CN | 109396396 | A | 3/2019 | |
| EP | 2606996 | A1 | 6/2013 | |
| JP | 2004092208 | A | 3/2004 | |
| KR | 20140145699 | A * | 12/2014 | E02F 9/2808 |
| WO | WO2010031663 | A1 | 3/2010 | |
| WO | WO-2017081665 | A1 * | 5/2017 | B22D 19/02 |

OTHER PUBLICATIONS

Hudson Tool Steel; Technical Data Sheet for HSS M2 Steel; https://hudsontoolsteel.com/technical-data/steelM2; Retrieved from the internet on Jan. 14, 2021 (Year: 2021).

Penticton Foundry, Alloy Data Sheet for 25% High Chromium Alloy (Cast Iron); https://www.pentictonfoundry.com/news/ alloy-data-sheet-25-high-chromium-alloy/; retrieved from the internet on Jan. 14, 2021 (Year: 2016).

* cited by examiner

COMPOSITE TOOTH WITH FRUSTOCONICAL INSERT

TECHNICAL FIELD

The present disclosure relates to a composite tooth intended to equip a machine for working the ground or rocks. It relates, in particular, to a tooth produced in a foundry comprising a metal matrix reinforced with a substantially frustoconical or pyramidal insert comprising particles of titanium carbides formed during an in-situ reaction at the time of the casting of the iron.

Definition

The expression "tooth" is to be interpreted in the broad sense and includes any element of any dimension, having a pointed or flat shape intended, in particular, to work the ground, the bottom of rivers or seas, and/or rocks in the open or in mines.

INTRODUCTION

Few means are known for modifying the hardness and impact resistance of a foundry alloy in depth "in the mass". Known means generally relate to shallow surface modifications (of a few millimeters). For teeth made in foundries, the reinforcing elements must be present in depth so as to withstand significant and simultaneous localized stresses in terms of mechanical stresses, wear and impact, and also because a tooth is used over a large portion of its length.

Hardfacing teeth with metal carbides (Technosphere®—Technogenia) by oxyacetylene welding is a well-known technique. Such hardfacing makes it possible to deposit a layer of carbides that is a few millimeters thick on the surface of a tooth. Such reinforcement is, however, not integrated into the metal matrix of the tooth and does not ensure the same performance as a tooth where a carbide reinforcement is fully incorporated into the mass of the metal matrix.

Document WO2010031660 discloses a composite tooth for working the ground or rocks, produced in a foundry and comprising a ferrous alloy reinforced at least in part with titanium carbide formed in situ according to a defined geometry. The reinforced portion of the tooth comprises an alternating macro-microstructure of millimetric areas concentrated with micrometric globular particles of titanium carbides separated by millimetric areas generally free of micrometric globular particles of titanium carbides. The areas concentrated with micrometric globular particles of titanium carbides form a microstructure in which the micrometric interstices between the globular particles are also filled by said ferrous alloy.

SUMMARY

The present disclosure aims to improve the performance of the composite teeth of the prior art, it aims to provide improved resistance to wear while maintaining good impact resistance. This property is obtained by a reinforcement insert specifically designed for this application. The insert comprises a structure which alternates (at a millimeter scale) areas which are dense with fine micrometric globular particles of metal carbides formed in situ with areas which are practically free of them within the metal matrix of the tooth. The macro-microstructure of the insert has a substantially flat frustoconical shape or a pyramidal shape, preferably truncated with a rectangular or square base, said shape possibly being hollow. The recess of the insert allows a faster "filling" of the insert with titanium carbides formed in situ during casting.

The present disclosure also provides a method for obtaining said reinforcing structure.

The present teachings disclose a composite tooth for working the ground or rocks, said tooth comprising a ferrous alloy reinforced at least in part with an insert in which said portion reinforced with the insert allows, after in-situ reaction, the obtention of an alternating macro-microstructure of millimetric areas concentrated with micrometric globular particles of titanium carbides separated by millimetric areas substantially free of micrometric globular particles of titanium carbides, said areas being concentrated with micrometric globular particles of titanium carbides forming a microstructure in which the micrometric interstices between said globular particles are also filled by said ferrous alloy and where said macro-microstructure generated by the insert is a few millimeters away from the distal surface of the tooth, preferably at least 2 to 3 mm, and particularly preferably, 4 or 5, or even 6 mm from the distal surface of the tooth. It is essential that the reinforced portion is not flush with the surface of said tooth.

According to particular embodiments of the present disclosure, the composite tooth comprises at least one or an appropriate combination of the following features:

- the insert has a flat frustoconical shape or a truncated pyramidal shape with a rectangular or square base, solid or at least partially hollow;
- said concentrated millimetric areas have a concentration in micrometric globular particles of titanium carbides greater than 35% by volume;
- said portion reinforced with the insert has an overall titanium carbide content between 25 and 45% by volume;
- the globular micrometric particles of titanium carbides have a size of less than 50 μm, preferably less than 20 μm;
- said areas concentrated with globular particles of titanium carbides comprise 36.9 to 72.2% by volume of titanium carbides;
- said areas concentrated with titanium carbides have a dimension varying from 0.5 to 12 mm, preferably varying from 0.5 to 6 mm, particularly preferably varying from 1.4 to 4 mm.

The present disclosure also discloses a method of manufacturing the composite tooth.

According to particular embodiments of the present disclosure, the method comprises at least one or an appropriate combination of the following features:

- providing an insert in the form of millimetric granules of a mixture of compacted powders comprising carbon and titanium precursor of titanium carbides; this may be obtained by molding with an adhesive or by confinement in a metal envelope which will melt during casting;
- introducing the insert into the mold of the tooth so that said insert is held a few millimeters from the distal surface of the tooth;
- casting a ferrous alloy into the mold, the heat of said casting triggering an exothermic self-propagating high temperature synthesis (SHS) reaction of titanium carbides within said precursor granules;
- forming, within the insert of the tooth, an alternating macro-microstructure of millimetric areas concentrated with micrometric globular particles of titanium carbides at the location of said precursor granules, said areas being separated from each other by millimetric areas substantially free of micrometric globular particles of titanium carbides, said globular particles also being separated within said millimetric areas concentrated with titanium carbides by micrometric interstices, in said macro-microstructure;

infiltrating the millimetric interstices, the micrometric interstices by said high temperature cast ferrous alloy, following the formation of microscopic globular particles of titanium carbides;

wherein the insert is made by molding or confinement.

The present disclosure also discloses a composite tooth obtained according to the method of the disclosure.

step (a) shows the device for mixing the titanium and carbon powders;

step (b) shows the compaction of the powders between two rolls followed by crushing and sifting with recycling of too fine particles;

a sand mold is shown at (c) in which a barrier has been placed to contain the powder granules compacted at the location of the reinforcement of the tooth;

an enlargement of the reinforcement area is shown at (d) in which the compacted granules comprising the reagents precursor of TiC are located.

Figure 2A:
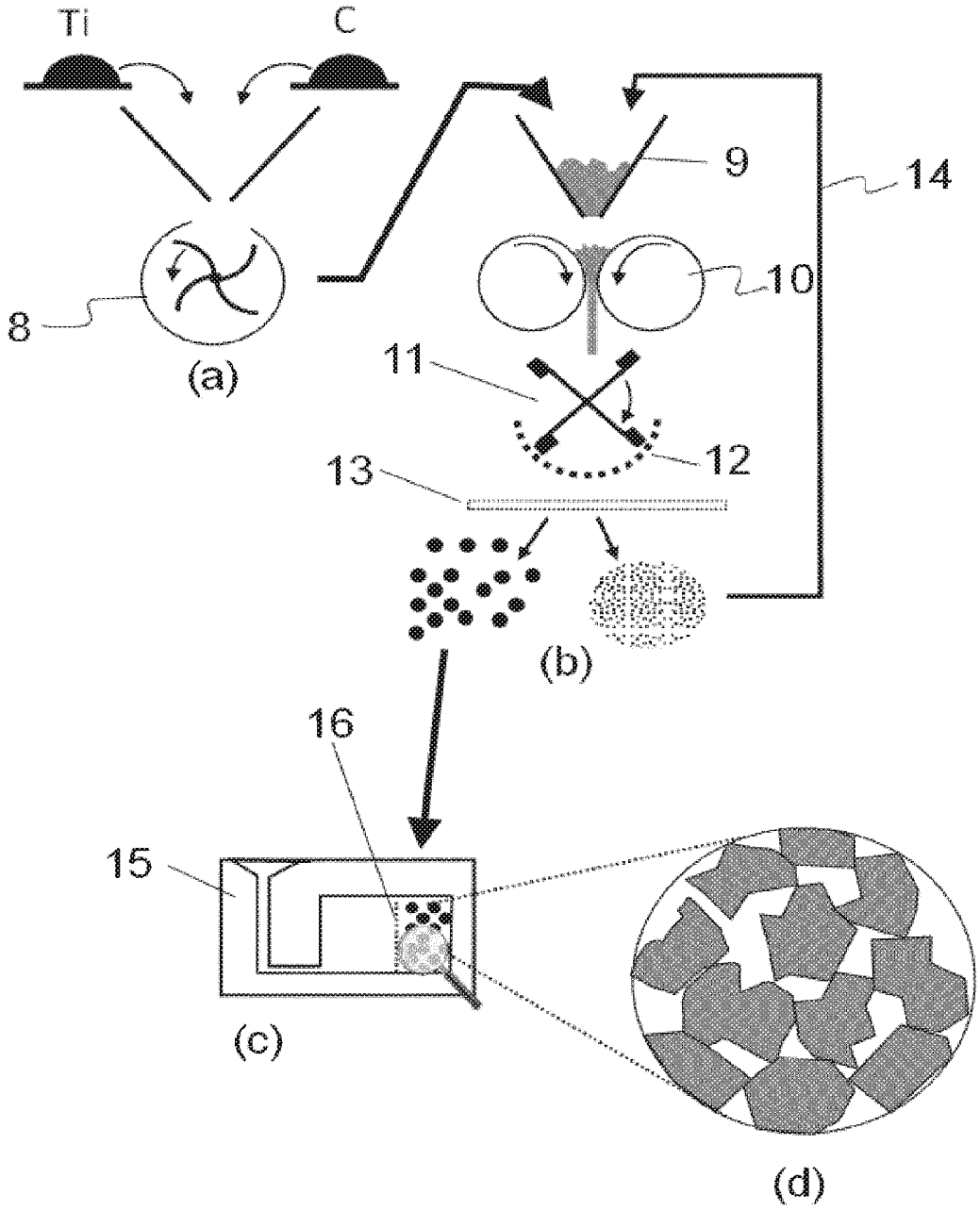
FIG. 2A depicts two steps of an illustrative method of manufacturing the tooth according to the present disclosure.
Figure 2B:
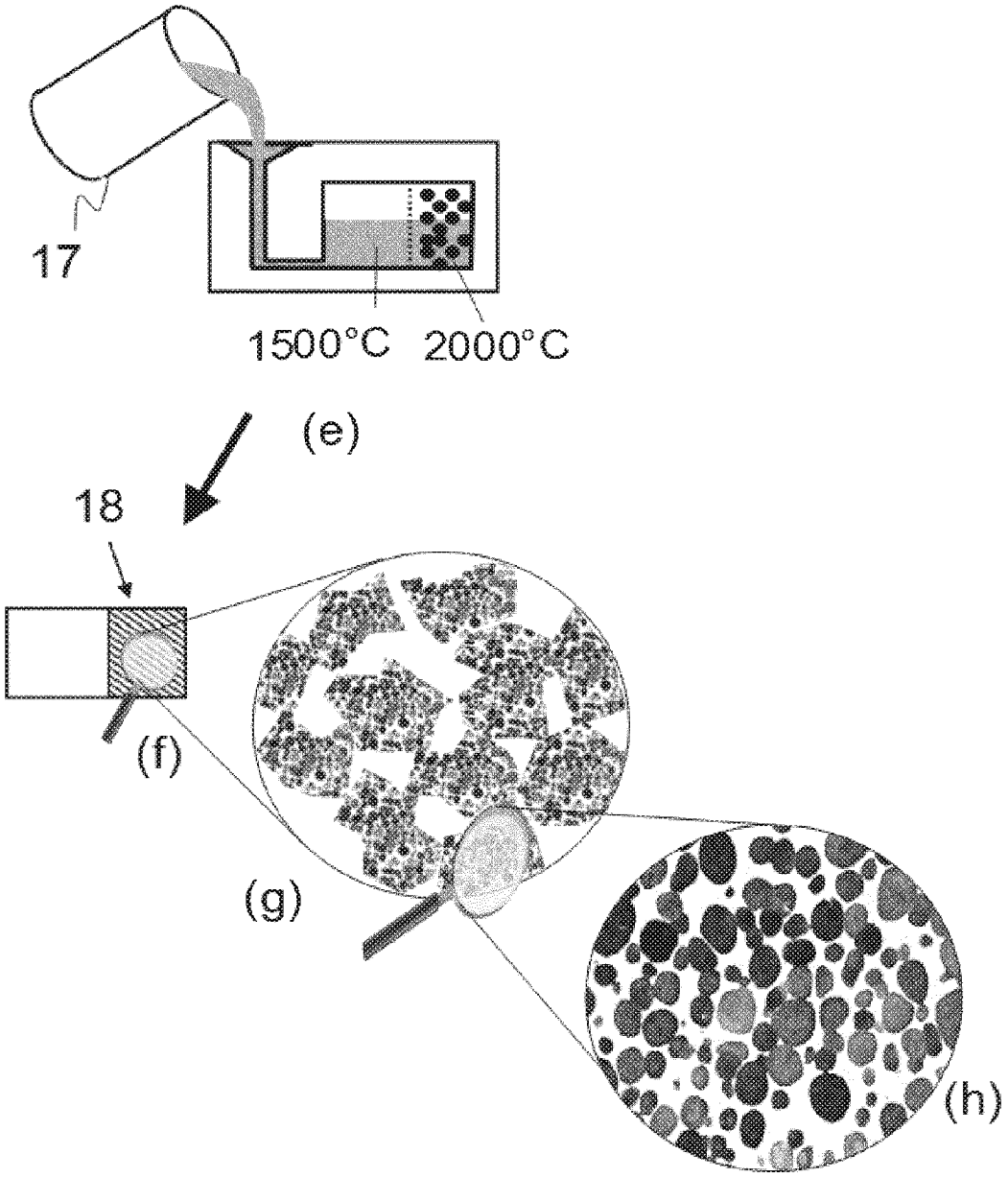
Figure 3:
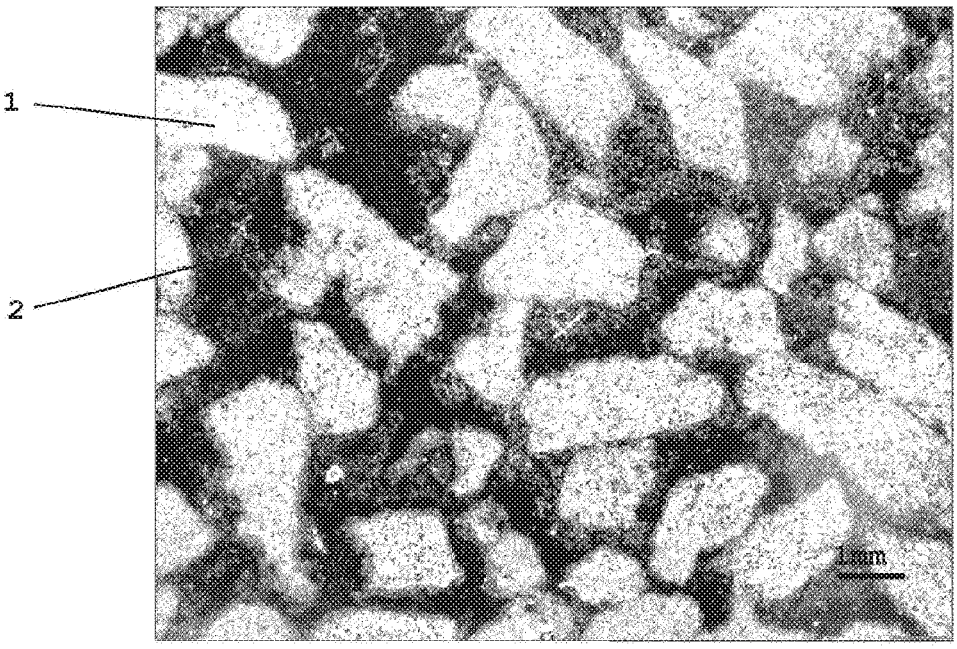

FIG. 2B depicts a third step of the illustrative method of manufacturing the tooth according to the present disclosure.

step (e) shows the casting of the ferrous alloy into the mold;

the tooth resulting from the casting is shown schematically at (f);

an enlargement of the areas with a high concentration of TiC globules is shown at (g)—this diagram illustrates the same areas as in FIG. 3;

an enlargement within a same area with a high concentration of TiC globules is shown at (h)—the micrometric globules are individually surrounded by the cast metal.

FIG. 3 illustrates a binocular view of a polished, non-etched surface of a section of the reinforced portion of the tooth according to the present disclosure with millimetric areas (in pale gray) concentrated with micrometric globular titanium carbides (TiC globules). The dark portion illustrates the metal matrix (steel or cast iron) filling both the space between these areas concentrated with micrometric globular titanium carbides but also the spaces between the globules themselves. (See FIGS. 4 and 5).

Figure 4:
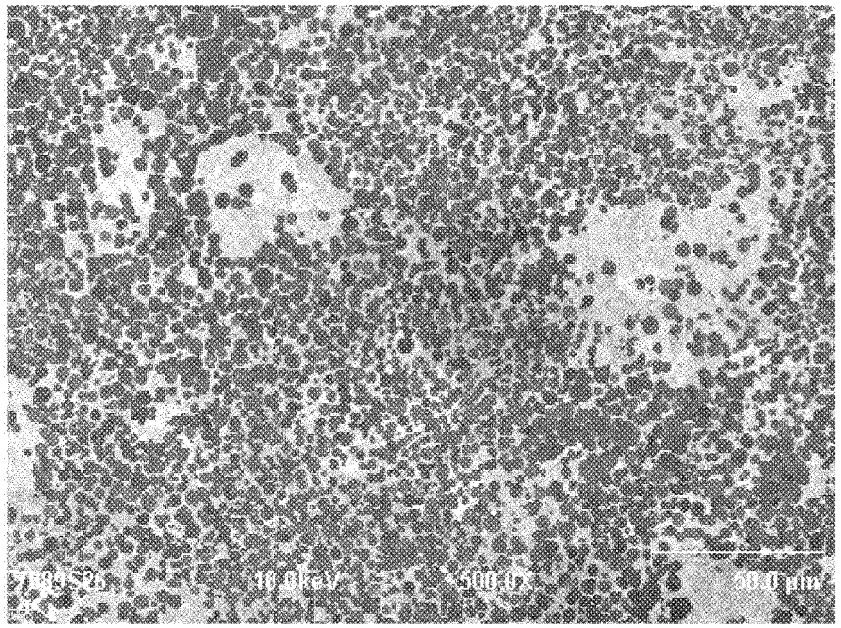

FIG. 4 shows a first view taken with a scanning electron microscope (SEM) of micrometric globular titanium carbides on polished, non-etched surfaces, at a first magnification. It may be seen that in this particular case most of the titanium carbide globules have a size smaller than 10 μm.

Figure 5:
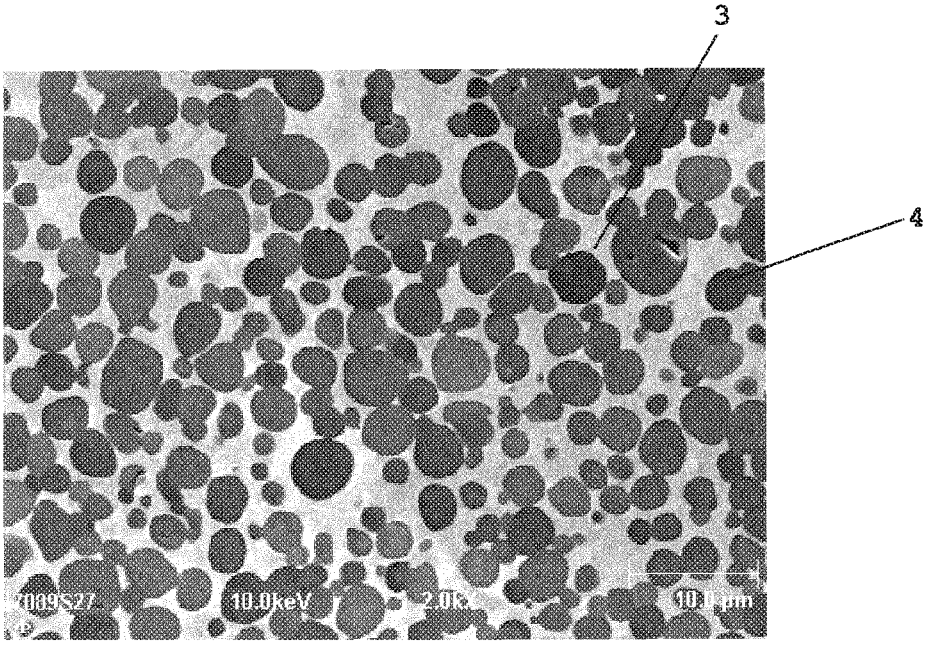

FIG. 5 shows a second view taken with a scanning electron microscope (SEM) of micrometric globular titanium carbides on polished, non-etched surfaces, at a second magnification. It may be seen that in this particular case most of the titanium carbide globules have a size smaller than 10 μm.

Figure 6:
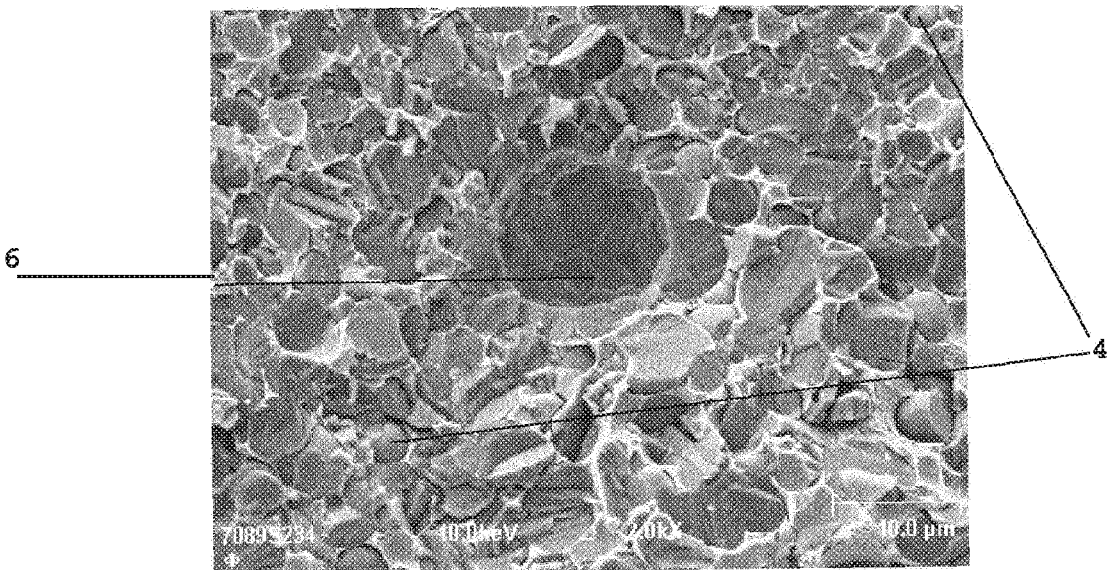

FIG. 6 illustrates a view of micrometric globular titanium carbides on a fracture surface taken with a scanning electron microscope (SEM). It may be seen that the titanium carbide globules are perfectly incorporated into the metal matrix. This proves that the cast metal completely infiltrates (permeates) the pores during casting once the chemical reaction between titanium and carbon is initiated during the SHS reaction.

Figure 7:
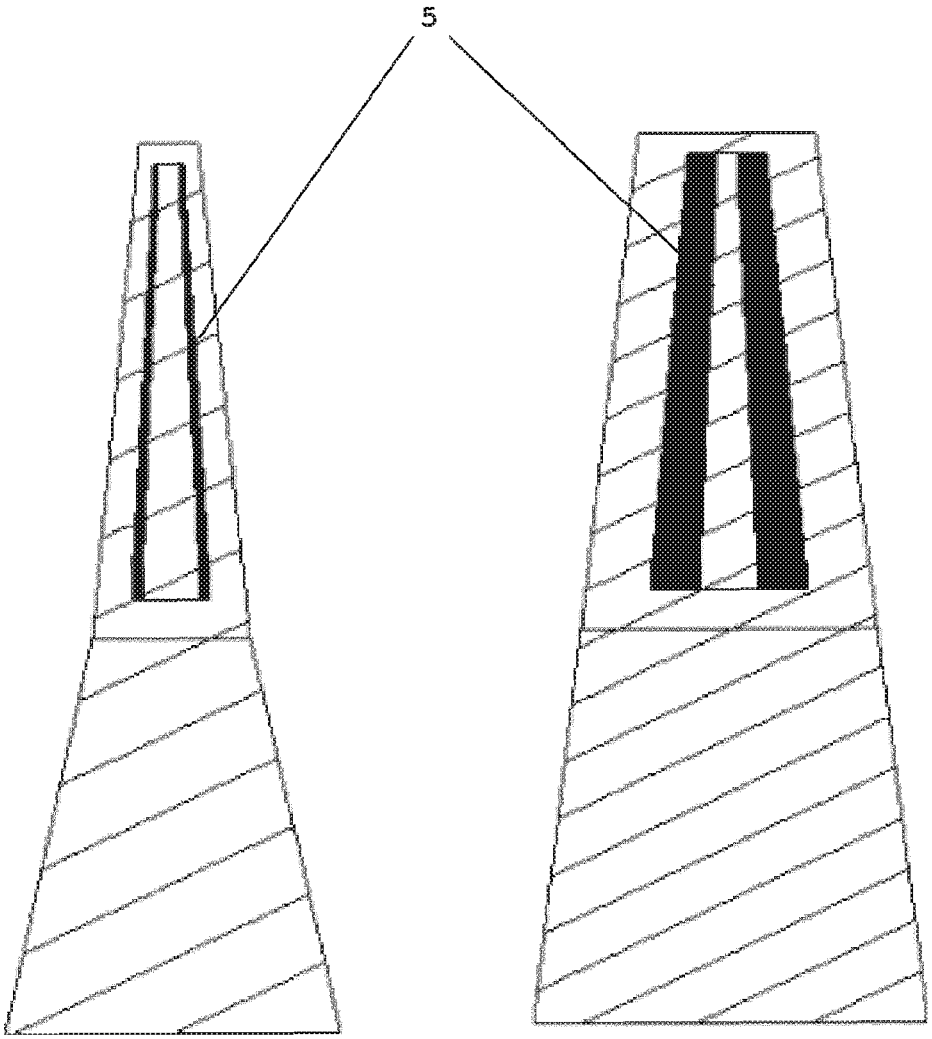

FIG. 7 shows two longitudinal sections of an exemplary tooth according to the present disclosure, the two sections being perpendicular to one another. In this figure, the insert is hollow and frustoconical.

Figure 8:
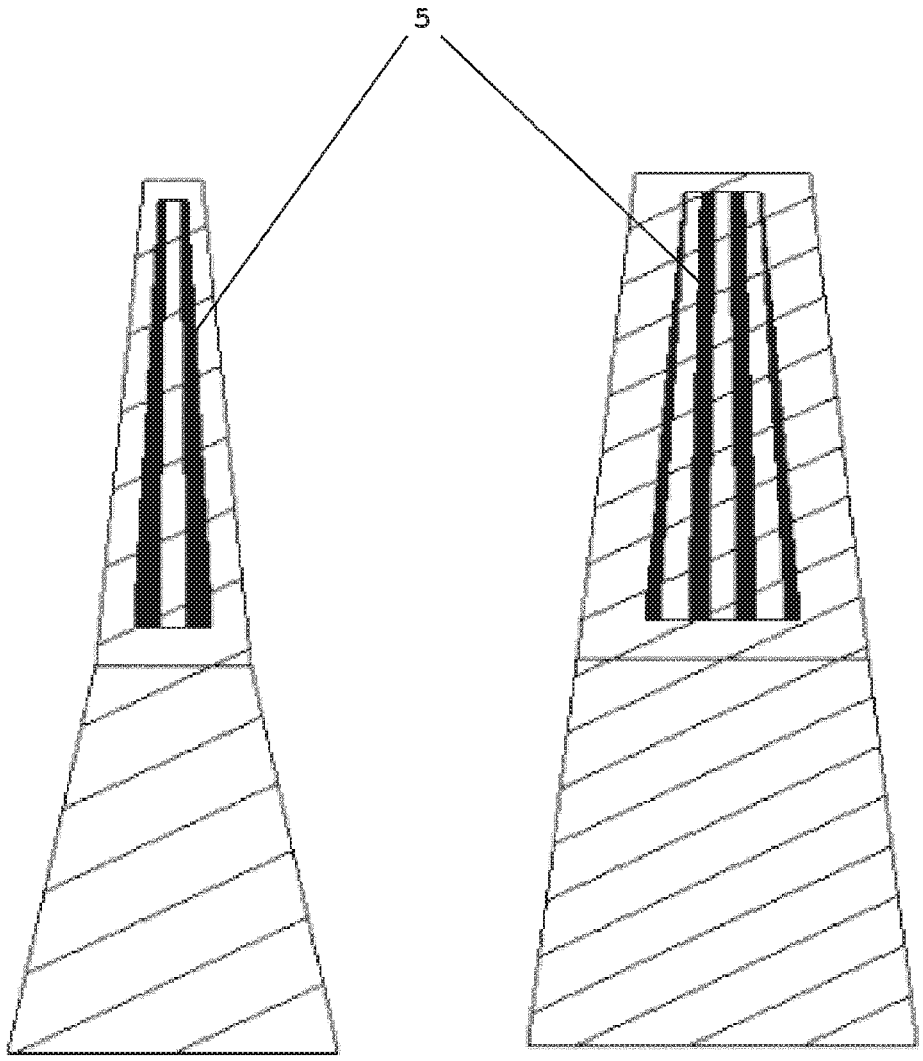

FIG. 8 shows two longitudinal sections of another example of a tooth according to the present disclosure, the two sections being perpendicular to each other. The insert of FIG. 8 comprises several tunnels passing longitudinally through the truncated cone.

Figure 9:
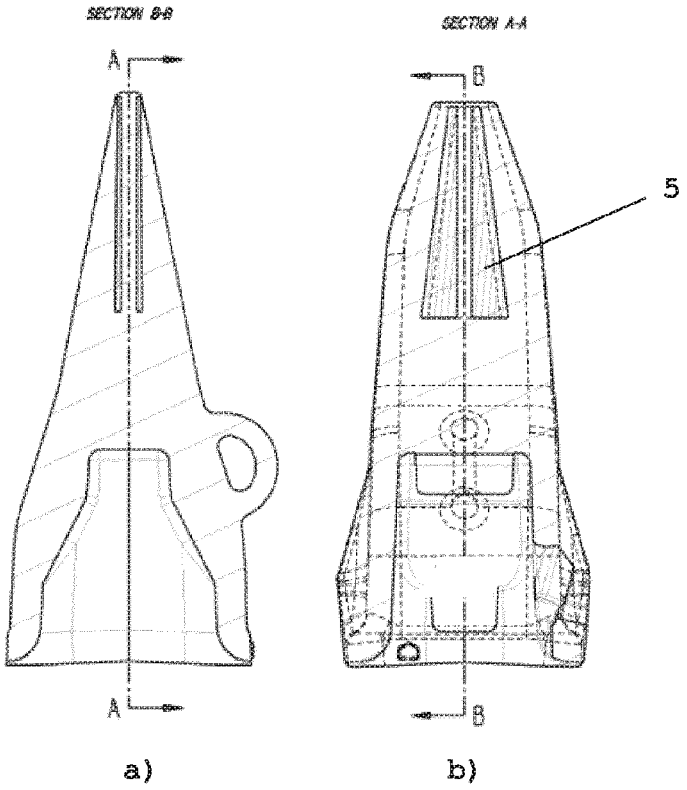

FIG. 9 shows two three-dimensional views of a tooth according to the present disclosure, the two views being perpendicular to one another.

Figure 10:
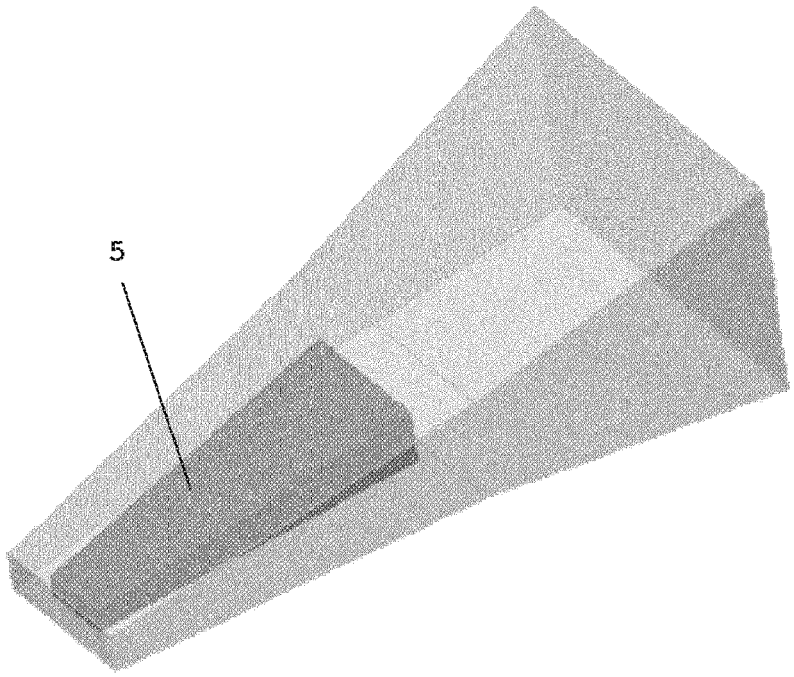

FIG. 10 shows a three-dimensional view of a tooth according to the present disclosure comprising an insert in the form of a truncated pyramid with a rectangular or square base. In this example, the insert is solid.

Figure 11:
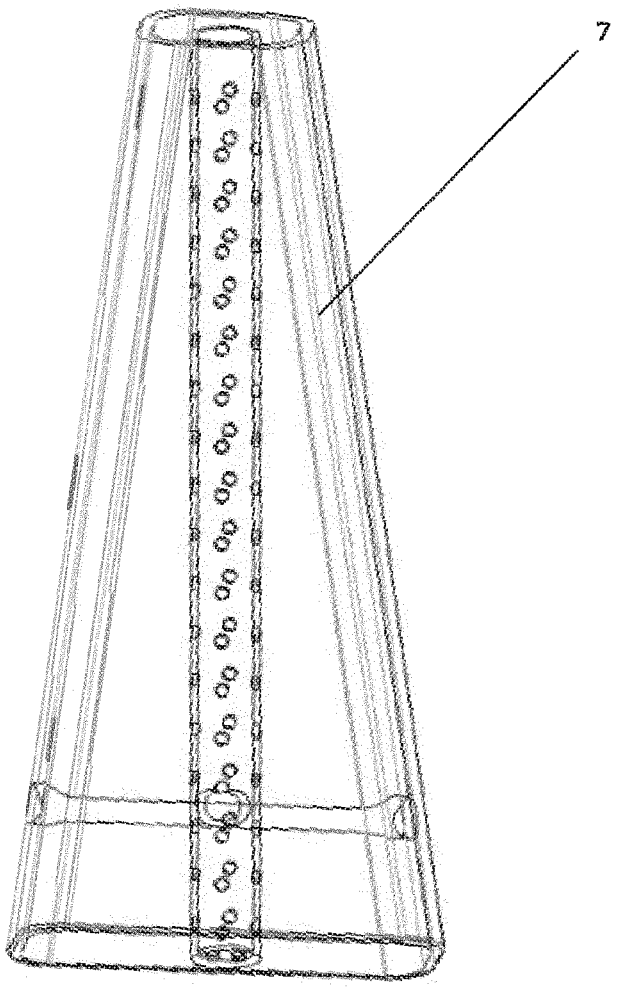

FIG. 11 illustrates a metallic container for the compacted granules of Ti/C mixture. This container makes it possible to put the mixture of granules in a flat, frustoconical shape that is at least partially hollow.

CAPTIONS

1. millimetric areas concentrated with micrometric globular particles (nodules) of titanium carbides (pale areas)
2. millimetric interstices filled with the cast ferrous alloy essentially free of micrometric globular particles of titanium carbides (dark areas)
3. micrometric interstices between the TiC nodules also infiltrated with the cast alloy
4. micrometric globular titanium carbides, in the areas concentrated with titanium carbides
5. insert of frustoconical or pyramidal shape, solid or partially or entirely hollow, fully integrated into the cast iron matrix and spaced a few millimeters from the distal end of the tooth.
6. gas defects
7. metal container for compacted granules of Ti/C mixture
8. Ti and C powder mixer
9. hopper
10. roll
11. crusher
12. outlet grid
13. sieve

14. recycling of too fine particles towards the hopper
15. sand mold
16. barrier containing the compacted granules of Ti/C mixture
17. cast ladle
18. tooth comprising an insert

DETAILED DESCRIPTION

In materials science, SHS refers to a "self-propagating high temperature synthesis" reaction where reaction temperatures generally above 1,500° C., or even 2,000° C., are reached. For example, the reaction between titanium powder and carbon powder to obtain titanium carbide TiC is highly exothermic. Only a little energy is needed for locally initiating the reaction. Then, the reaction will spontaneously propagate to the entire mixture of reagents by means of the high temperatures reached. After initiation of the reaction, a reaction front develops which thus propagates spontaneously (self-propagating) and which makes it possible to obtain titanium carbide from titanium and carbon. The thereby obtained titanium carbide is said to be "obtained in situ" because it does not stem from the cast ferrous alloy and has not been added to the mold in the form of TIC crushed into powder.

The mixtures of reagent powders comprise carbon powder and titanium powder and are compressed into plates and then crushed so as to obtain granules the size of which varies from 1 to 12 mm, preferably from 1 to 6 mm. These granules are not 100% compacted. They are generally compressed between 55 and 95% of the theoretical density. These granules allow easy use/handling (see FIGS. 2A and 2B).

These millimetric granules of mixed carbon and titanium powders obtained according to the diagrams of FIGS. 2A and 2B are the precursors of the titanium carbide to be created.

The composite tooth for working the ground or rocks according to the present disclosure comprises an insert of the frustoconical type or pyramidal type, preferably truncated with a rectangular or square base, preferably of the hollow type, made in grains by a mixture of carbon and titanium powders and making it possible, after SHS reaction, to obtain a macro-microstructure, i.e. a reinforcement network which may also be referred to as a three-dimensional alternating structure of areas concentrated with micrometric globular particles of titanium carbides separated by areas which are practically free from them. Such a structure is obtained by the reaction in the mold 15 of the granules comprising a mixture of carbon and titanium powders and having been previously shaped either by holding the grains with an adhesive in a mold or simply in a perforated metal container, which will melt at least partially during casting. The SHS reaction is initiated by the casting heat of the cast iron or the steel used to cast the entire part of the tooth and therefore both the non-reinforced portion and the reinforced portion (see FIG. 2B (e)). Casting therefore triggers an exothermic self-propagated high temperature synthesis reaction of the mixture of carbon and titanium powders compacted in the form of granules (self-propagating high-temperature synthesis—SHS), previously agglomerated in the form of a frustoconical insert, preferably at least partially hollow and placed in the mold 15. The reaction then has the particularity of continuing to propagate as soon as it is initiated.

This high temperature synthesis (SHS) allows easy infiltration of all the millimetric and micrometric interstices, by the cast iron or the cast steel (FIG. 2B (g) and (h)). By increasing wettability, infiltration may be carried out over any reinforcement thickness or depth of the tooth. It advantageously makes it possible to create, after SHS reaction and infiltration by an external cast metal, an insert not flush with the distal end of the tooth and comprising a high concentration of micrometric globular particles of titanium carbides (which may further be called clusters of nodules), these areas having a size of the order of a millimeter or a few millimeters, and alternating with areas substantially free of globular titanium carbides.

Once these granules have reacted according to an SHS reaction, the reinforcement areas where these granules were located show a concentrated dispersion of micrometric globular particles 4 of TiC carbides (globules), the micrometric interstices 3 of which have also been infiltrated by the cast metal which is here cast iron or steel. It is important to note that the millimetric and micrometric interstices are infiltrated by the same metal matrix as that which constitutes the non-reinforced portion of the tooth; this allows complete freedom of choice of the cast metal. In the tooth finally obtained, the reinforcement areas with a high concentration of titanium carbides are composed of micrometric globular particles of TiC at a high percentage (between approximately 35 and approximately 70% by volume) and of the infiltrating ferrous alloy.

By micrometric globular particles should be understood overall spheroidal particles which have a size ranging from one micrometer to a few tens of micrometers at most, the vast majority of these particles having a size smaller than 50 μm, and even 20 μm, or even 10 μm. We also call them TiC globules. This globular shape is characteristic of a method of obtaining titanium carbide by self-propagating SHS synthesis (see FIG. 5).

Obtaining the Granules (Ti+C Version) for Reinforcing the Tooth

The method for obtaining the granules is illustrated in FIGS. 2*a*-2*h*. The granules of carbon/titanium reagents are obtained by compaction between rolls 10 so as to obtain strips which are then crushed in a crusher 11. The powders are mixed in a mixer 8 consisting of a tank provided with blades so as to promote homogeneity. The mixture then passes into a granulation apparatus via a hopper 9. This machine comprises two rolls 10, through which the material is passed. Pressure is applied to these rolls 10, which makes it possible to compress the material. At the outlet, a strip of compressed material is obtained which is then crushed so as to obtain the granules. These granules are then sifted to the desired grain size in a sieve 13. An important parameter is the pressure applied on the rolls. The higher this pressure, the more the strip, and thus the granules, will be compressed. It is thus possible to vary the density of the strips, and consequently of the granules, between 55 and 95% of the theoretical density which is 3.75 g/cm3 for the stoichiometric mixture of titanium and carbon. The apparent density (taking into account the porosity) is then between 2.06 and 3.56 g/cm3.

The compaction level of the strips depends on the pressure applied (in Pa) on the rolls (diameter 200 mm, width 30 mm). For a low compaction level, of the order of 106 Pa, a density of the order of 55% of the theoretical density is obtained on the strips. After passing through the rolls 10 to compress this material, the apparent density of the granules is 3.75×0.55, or 2.06 g/cm3.

For a high compaction level, of the order of 25.106 Pa, a density of 90% of the theoretical density is obtained on the strips, i.e. an apparent density of 3.38 g/cm3. In practice, it is possible to go up to 95% of the theoretical density.

Therefore, the granules obtained from the Ti+C raw material are porous. This porosity varies from 5% for very highly compressed granules, to 45% for slightly compressed granules.

In addition to the level of compaction, it is also possible to adjust the grain size distribution of the granules as well as their shape during the operation of crushing the strips and sieving the Ti+C granules. Unwanted grain size fractions are recycled at will (see FIG. 3*b*). Overall, the granules obtained have a size between 1 and 12 mm, preferably between 1 and 6 mm, and particularly preferably between 1.4 and 4 mm.

Production of the Reinforcement Area in the Composite Tooth According to the Present Disclosure The granules are produced as described above. To obtain a three-dimensional structure of the flat frustoconical type or of the pyramidal type preferably truncated with a rectangular or square base, or a superstructure/macro-microstructure with these granules, the latter are placed in an insert mold 7, and the granules are agglomerated therein either by means of an adhesive, or by any other means such as, for example, a perforated metal container which will at least partially melt during the casting. The insert mold may be, for example, an elastomer mold making it possible to give the desired final shape to the insert 5. The insert, of hollow frustoconical shape or not, is arranged in such a way in the casting mold so as not to be flush with the distal surface of the tooth. Care will always be taken to maintain a space of a few millimeters between the end of the insert and the outer surface obtained after casting the tooth, at the location where this distance is the smallest, namely the distal end of the tooth which is the most subject to wear. The distance will also vary depending on the size of the tooth. It should be at least 1 mm, preferably at least 2 or 3 mm and particularly preferably at least 4 or 5 mm.

The bulk density of the stack of Ti+C granules is measured according to the ISO 697 standard and depends on the compaction level of the strips, the grain size distribution of the granules and the method for crushing the strips, which influences the shape of the granules.

The bulk density of these Ti+C granules is generally of the order of 0.9 g/cm3 to 2.5 g/cm3 depending on the compaction level of these granules and the density of the stack.

Before reaction, there is thus an agglomerate of porous granules composed of a mixture of titanium powder and carbon powder, forming a flat frustoconical insert or a truncated pyramidal insert with a rectangular or square base, the insert possibly being solid or at least partially hollow.

The insert is then placed in the mold 15 of the tooth, in the area of the mold where it is desired to reinforce the part. The insert is placed as illustrated in FIGS. 7 to 10 so that it is not flush with the surface of the tooth once the tooth is formed. Then the metal to form the tooth is poured into the mold 15.

During the Ti+C→TiC reaction, a volume contraction of the order of 24% occurs upon passing from the reagents to the product (contraction coming from the difference in density between the reagents and the products). Thus, the theoretical density of the Ti+C mixture is 3.75 g/cm3, and the theoretical density of TiC is 4.93 g/cm3. In the final product, after the reaction to obtain TiC, the cast metal will infiltrate:

- the microscopic porosity present in spaces with a high concentration of titanium carbides, depending on the initial compaction level of these granules;
- the millimetric spaces between the areas with a high concentration of titanium carbides, depending on the initial stack of the granules (bulk density);
- the porosity coming from the volume contraction during the reaction between Ti+C for obtaining the TiC;
- possibly the hollow central space of the insert, if it is initially hollow.

EXAMPLES

In the following example, we used the following raw materials:

- titanium, H. C. STARCK, Amperit 155.066, less than 200 mesh,
- carbon graphite GK Kropfmuhl, UF4, >99.5%, less than 15 μm,
- Fe, in the form of Steel HSS M2, less than 25 μm, proportions:

Ti+C 100 g Ti-24.5 g C

Ti+C+Fe 100 g Ti-24.5 g C-35.2 g Fe

Mixing for 15 min in a Lindor mixer, under argon.

The granulation was carried out with a Sahut-Conreur granulator.

For the Ti+C+Fe and Ti+C mixtures, the compactness of the granules was obtained by varying the pressure between the rolls from 10 to 250.105 Pa.

The insert was produced by confining Ti+C granules in a perforated metal container (thin perforated sheet) which was then carefully placed in the casting mold of the tooth a few millimeters from the surface of the mold, at the location where the tooth is likely to be reinforced. Then, the steel or cast iron is poured into this mold and the perforated container melts, freeing the space for infiltration by the cast metal.

Example 1

In this example, a powdered ferrous alloy is added to the carbon-titanium mixture so as to attenuate the intensity of the reaction between carbon and titanium. The aim is to produce a tooth in which the reinforced areas comprise an overall volume percentage of TiC of approximately 30%. For this purpose, a strip is produced by compaction to 85% of the theoretical density of a mixture of 15% C, 63% Ti and 22% Fe by weight. After crushing, the granules are sifted so as to obtain a granule size between 1.4 and 4 mm. A bulk density of the order of 2 g/cm3 is obtained (45% of space between the granules+15% of porosity in the granules). The granules are placed in a container which thus comprises after tamping and/or vibration 60% by volume of porous granules, taking into account the perforations made. After reaction, 60% by volume of areas with a high concentration of approximately 55% globular titanium carbides are obtained in the reinforced portion, i.e. 33% by overall volume of titanium carbides in the reinforced macro-microstructure of the tooth.

The following tables show the many possible combinations.

TABLE 1

Overall percentage of TiC obtained in the reinforced macro-microstructure after reaction of Ti + 0.98 C + Fe in the reinforced portion of the tooth.

| | | Compaction of the granules (% of the theoretical density which is 4.25 g/cm$^3$) | | | | | | | | |
|---|---|---|---|---|---|---|---|---|---|---|
| | | 55 | 60 | 65 | 70 | 75 | 80 | 85 | 90 | 95 |
| Filling of the reinforced portion of the part with 23% perforation (volume %) | 80 | 22.9 | **25.0** | 27.1 | 29.2 | 31.2 | 33.3 | 35.4 | 37.5 | 39.6 |
| | 75 | 21.5 | 23.4 | **25.4** | 27.3 | 29.3 | 31.2 | 33.2 | 35.1 | 37.1 |
| | 70 | 20.0 | 21.9 | 23.7 | **25.5** | 27.3 | 29.2 | 31.0 | 32.8 | 34.6 |
| | 65 | 18.6 | 20.3 | 22.0 | 23.7 | **25.4** | 27.1 | 28.8 | 30.5 | 32.2 |
| | 55 | 15.8 | 17.2 | 18.6 | 20.0 | 21.5 | 22.9 | **24.3** | 25.8 | 27.2 |
| | 45 | 12.9 | 14.1 | 15.2 | 16.4 | 17.6 | 18.7 | 19.9 | 21.1 | 22.3 |

To obtain an overall TiC concentration in the reinforced portion of about volume 25% (in bold characters in the table), different combinations may be used, for example 60% compaction and 80% filling, or 65% compaction and 75% filling, or 70% compaction and 70% filling, or further 85% compaction and 55% filling.

TABLE 2

Relationship between the compaction level, the theoretical density and the TiC percentage, obtained after reaction in the granule, while taking into account the presence of iron

| | Compaction of the granules | | | | | | | | |
|---|---|---|---|---|---|---|---|---|---|
| | 55 | 60 | 65 | 70 | 75 | 80 | 85 | 90 | 95 |
| Density in g/cm$^3$ | 2.34 | 2.55 | 2.76 | 2.98 | 3.19 | 3.40 | 3.61 | 3.83 | 4.04 |
| TiC obtained after reaction (and contraction) in volume % in the granules | 36.9 | 40.3 | 43.6 | 47.0 | 50.4 | 53.7 | 57.1 | 60.4 | 63.8 |

TABLE 3

Bulk density of the stack of granules (Ti + C + Fe)

| | | Compaction | | | | | | | | |
|---|---|---|---|---|---|---|---|---|---|---|
| | | 55 | 60 | 65 | 70 | 75 | 80 | 85 | 90 | 95 |
| Filling of the reinforced portion of the part in volume % | 80 | 1.9 | 2.0 | 2.2 | 2.4 | 2.6 | 2.7 | 2.9 | 3.1 | 3.2 |
| | 75 | 1.8 | 1.9 | 2.1 | 2.2 | 2.4 | 2.6 | 2.7 | 2.9 | 3.0 |
| | 70 | 1.6 | 1.8 | 1.9 | 2.1 | 2.2 | 2.4 | 2.5 | 2.7 | 2.8 |
| | 65 | 1.5* | 1.7 | 1.8 | 1.9 | 2.1 | 2.2 | 2.3 | 2.5 | 2.6 |
| | 55 | 1.3 | 1.4 | 1.5 | 1.6 | 1.8 | 1.9 | 2.0 | 2.1 | 2.2 |
| | 45 | 1.1 | 1.1 | 1.2 | 1.3 | 1.4 | 1.5 | 1.6 | 1.7 | 1.8 |

*Bulk density (1.5) = theoretical density (4.25) × 0.65 (filling) × 0.55 (compaction)

Advantages

Better Resistance of the Insert to Crack and Fracture

The present disclosure makes it possible to reduce the phenomenon of cracking of the tooth, during its manufacture but also in use.

During the manufacture of the teeth, the rejection rate is reduced, in particular by virtue of hollow frustoconical cones or hollow truncated pyramids which make it possible to reduce the ceramic concentration in the part overall. Too much ceramic potentially causes cracking and/or infiltration defects.

On the other hand, the wear of the teeth in use is reduced thanks to the inserts of the present disclosure. Indeed, the cracking of the ceramic is reduced when the insert is not immediately exposed on the surface. The fracture initiators which could weaken the tooth stressed in service are thus reduced.

Furthermore, the cracks generally originate at the most brittle locations, which in this case are the TiC particle or the interface between this particle and the infiltration metal alloy. If a crack originates at the interface or in the micrometric TiC particle, the propagation of this crack is then hindered by the infiltration alloy that surrounds this particle. The toughness of the infiltration alloy is greater than that of the ceramic TiC particle. The crack needs more energy to pass from one particle to another, so as to cross the micrometric spaces that exist between the particles.

Maximum Flexibility for the Application Parameters

In addition to the compaction level of the granules, the wall thickness and the shape of the frustoconical or pyramidal insert may be varied when the insert is hollow.

Low Sensitivity to Crack During the Manufacturing of the Tooth

The expansion coefficient of the TiC reinforcement is lower than that of the ferrous alloy matrix (expansion coefficient of TiC: 7.5 $10^{-6}$/K and of the ferrous alloy: approximately 12.0 $10^{-6}$/K). This difference in expansion coefficients has the consequence of generating stresses in the material during the solidification phase and also during the heat treatment. If these stresses are too significant, cracks may appear in the part and lead it to be discarded. In the present disclosure, the recesses in the insert make it possible to reduce the proportion of TiC reinforcement (less than 45% by volume in the reinforced macro-microstructure), which reduces stresses in the part. In addition, the presence of a more ductile matrix between the micrometric globular TiC particles in the alternating areas of low and high concentration makes it possible to better handle local stresses.

Excellent Retention of the Reinforcement in the Tooth

In the present disclosure, the limit between the insert and the non-reinforced portion of the tooth is not abrupt since there is a continuity of the metal matrix between the insert and the non-reinforced portion, thanks to the hollow frustoconical and pyramidal inserts, which protects it against a complete detachment of the insert.

Reduced Costs and Increased Speed of Tooth Formation

The small volume of a hollow frustoconical or pyramidal insert also makes it possible to reduce the overall amount of TiC, likewise reducing the cost of the part. The hollows also allow faster "filling" of the insert during casting.

Test Results

Figure 1A:
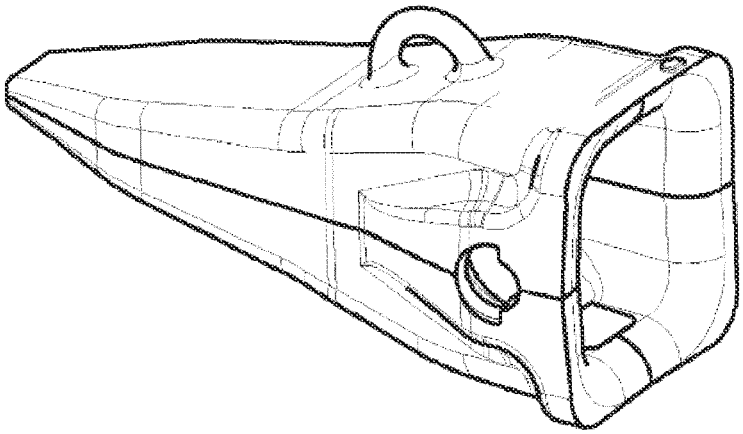
FIG. 1A shows a three-dimensional view of a commercial tooth intended to be reinforced according to the disclosure. This type of tooth may have very variable dimensions ranging on average from a few tens of centimeters to more than one meter.
Figure 1B:
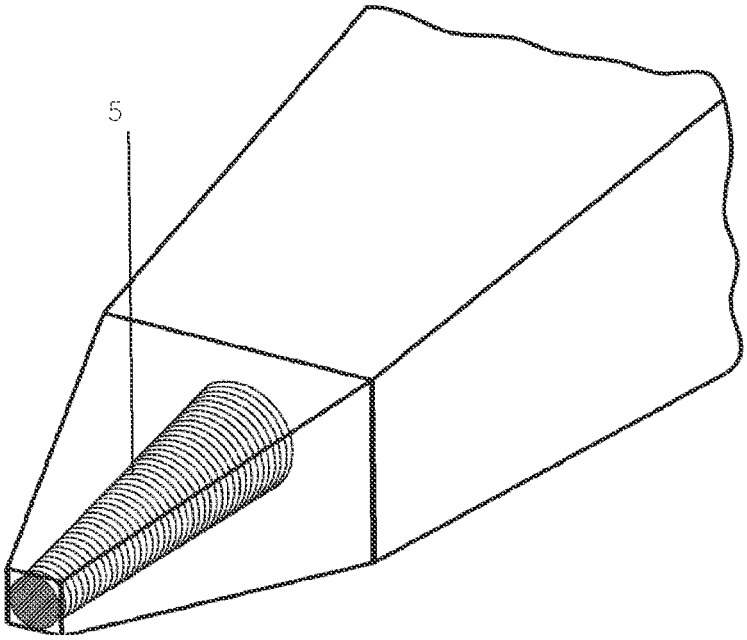
Fig. 1B Prior Art
FIG. 1B shows a schematic three-dimensional view of a tooth with a frustoconical reinforcement that is flush with the surface of the distal end of the tooth according to the prior art.
Figure 1C:
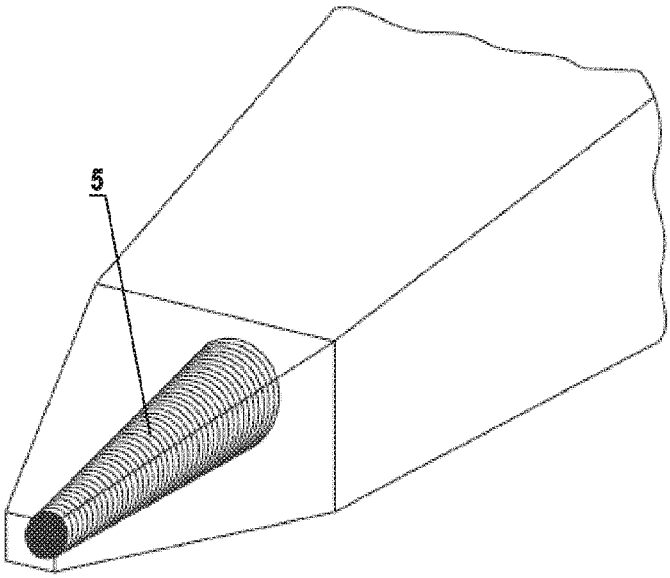
FIG. 1C shows a reinforced tooth according to the present disclosure with an insert of substantially frustoconical shape that is full or at least partially hollow. The insert is located at a distance of a few millimeters from the surface at the distal end of the reinforced tooth. It is therefore not flush with the surface of the tooth.
Figure 1D:
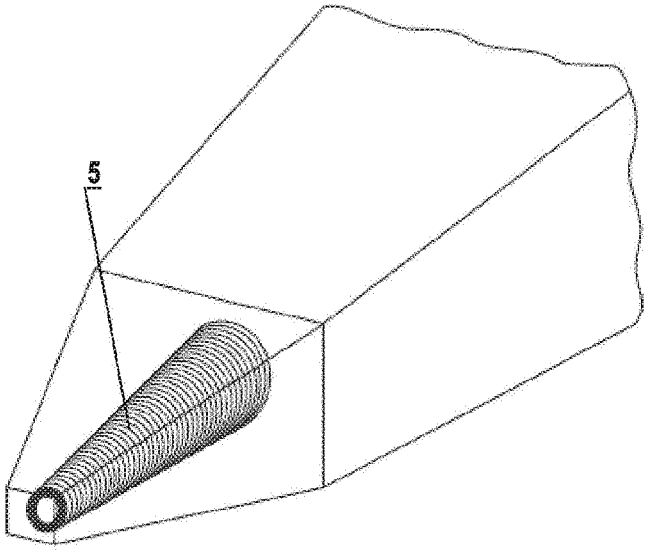
FIG. 1D shows another reinforced tooth according to the present disclosure with an insert of substantially frustoconical shape that is full or at least partially hollow. The insert is located at a distance of a few millimeters from the surface at the distal end of the reinforced tooth. It is therefore not flush with the surface of the tooth.

The advantages of the tooth according to the present disclosure over a composite tooth of the disclosure described above in FIG. 1*b* for instance are an improved resistance to breakage during bending tests on a test bench of the order of 300%. In more detail, and depending on the test conditions, it was possible to observe the following performances (expressed in kN, which represents the maximum load before fracture) for the products made according to the present disclosure (reinforcement as illustrated in FIG. 8 comprising overall a percentage by volume of TiC of 33%—Example 1) in comparison with identical teeth with a reinforcement as illustrated in FIG. 1*a:* 2.8 times.

ILLUSTRATIVE FEATURES AND COMBINATIONS

The following series of paragraphs is presented without limitation to describe additional aspects and features of the disclosure:

A0. A composite tooth for working the ground or rocks, said tooth comprising a ferrous alloy reinforced at least partially with an insert (5), said portion reinforced with the insert (5) allowing, after in-situ reaction, the obtention of an alternating macro-microstructure of millimetric areas (1) concentrated with micrometric globular particles of titanium carbides (4) separated by millimetric areas (2) substantially free of micrometric globular particles of titanium carbides (4), said areas concentrated with micrometric globular particles of titanium carbides (4) forming a microstructure in which the micrometric interstices (3) between said globular particles (4) are also filled by said ferrous alloy and characterized in that said macro-microstructure generated by the insert (5) is at least 2 mm, preferably at least 3 mm from the distal surface of said tooth.

A1. The tooth according to paragraph A0, wherein the insert (5) has a flat frustoconical shape or a truncated pyramidal shape with a rectangular or square base, solid or at least partially hollow.

A2. The tooth according to any one of paragraphs A0 through A1, wherein said concentrated millimetric areas have a concentration of micrometric globular particles of titanium carbides (4) greater than 35% by volume.

A3. The tooth according to any one of paragraphs A0 through A2, wherein said portion reinforced with the insert (5) has an overall titanium carbide content between 25 and 45% by volume.

A4. The tooth according to any one of paragraphs A0 through A3, wherein the micrometric globular particles of titanium carbides (4) have a size of less than 50 μm, preferably less than 20 μm.

A5. The tooth according to any one of paragraphs A0 through A4, wherein said areas concentrated with globular particles of titanium carbides (1) comprise 36.9 to 72.2% by volume of titanium carbides.

A6. Tooth according to any one of paragraphs A0 through A5, wherein said areas concentrated with titanium carbides (1) have a dimension varying from 0.5 to 12 mm, preferably varying from 0.5 to 6 mm, particularly preferably varying from 1.4. to 4 mm.

A7. A method of manufacturing by casting a composite tooth according to any one of paragraphs A0 through A6, comprising the following steps:

providing an insert in the form of millimetric granules of a mixture of compacted powders comprising carbon and titanium precursor of titanium carbides, introducing the insert (5) into the mold (15) of the tooth so that said insert (5) is held a few millimeters from the distal surface of the tooth;

casting a ferrous alloy into the mold (15), the heat of said casting triggering an exothermic self-propagating high temperature synthesis (SHS) reaction of titanium carbides within said precursor granules;

forming, within the insert (5) of the tooth, an alternating macro-microstructure of millimetric areas (1) concentrated with micrometric globular particles of titanium carbides (4) at the location of said precursor granules, said areas being separated from each other by millimetric areas (2) substantially free of micrometric globular particles of titanium carbides (4), said globular particles (4) also being separated within said millimetric areas (1) concentrated with titanium carbides by micrometric interstices (3) in said macro-microstructure;

infiltrating the millimetric interstices (2), the micrometric interstices (3) by said high temperature cast ferrous alloy, following the formation of microscopic globular particles of titanium carbides (4).

A8. The manufacturing method according to paragraph A7, wherein the insert (5) has a flat frustoconical shape or a truncated pyramidal shape with a rectangular base, solid or at least partially hollow.

A9. The manufacturing method according to any one of paragraphs A7 through A8, wherein the mixture of compacted powders of titanium and carbon comprises a powder of a ferrous alloy.

A10. The manufacturing method according to any one of paragraphs A7 through A9, wherein said carbon is graphite.

A11. The manufacturing method according to any one of paragraphs A7 through A10, wherein the insert is produced by molding or by confinement.

A12. A Tooth obtained according to any one of paragraphs A7 through A11.

The invention claimed is:

1. A composite tooth for working the ground or rocks, the tooth comprising:

a ferrous alloy having a portion reinforced at least partially by an insert in the form of a hollow cone, the insert comprising an alternating macro-microstructure obtained by in situ reaction, wherein the alternating macro-microstructure comprises millimetric areas concentrated with micrometric globular particles of titanium carbides separated by millimetric areas substantially free of micrometric globular particles of titanium carbides;

wherein the millimetric areas concentrated with micrometric globular particles of titanium carbides form a microstructure in which micrometric interstices between the globular particles are also filled by the ferrous alloy of the tooth, such that the ferrous alloy of the tooth is continuous between an interior of the hollow cone and an exterior of the hollow cone; and wherein the macro-microstructure of the insert is at least 2 mm from a distal surface of the tooth.

2. The tooth according to claim 1, wherein the concentrated millimetric areas have a concentration of micrometric globular particles of titanium carbides greater than 35% by volume.

3. The tooth according to claim 1, wherein the portion reinforced with the insert has an overall titanium carbide content between 25% and 45% by volume.

4. The tooth according to claim 1, wherein the micrometric globular particles of titanium carbides have a size of less than 50 μm.

5. The tooth according to claim 1, wherein the areas concentrated with globular particles of titanium carbides comprise 36.9 to 72.2% by volume of titanium carbides.

6. The tooth according to claim 1, wherein the areas concentrated with titanium carbides have a dimension varying from 0.5 to 12 mm.

7. A method of manufacturing by casting the composite tooth according to claim 1, the method comprising:

providing the insert in the form of millimetric granules of a mixture of compacted powders comprising carbon and titanium precursor of titanium carbides;

introducing the insert in the form of the hollow cone into a mold of the tooth so that the insert is held at least two millimeters from the distal surface of the tooth;

casting the ferrous alloy into the mold, wherein heat from the casting triggers an exothermic self-propagating high temperature synthesis (SHS) reaction of titanium carbides within the precursor granules;

forming, within the insert of the tooth, the alternating macro-microstructure of millimetric areas concentrated with micrometric globular particles of titanium carbides at a location of the precursor granules, the areas being separated from each other by millimetric areas substantially free of micrometric globular particles of titanium carbides, the globular particles also being separated within the millimetric areas concentrated with titanium carbides by micrometric interstices in the macro-microstructure; and infiltrating the millimetric interstices and the micrometric interstices by the high temperature cast ferrous alloy, following the formation of microscopic globular particles of titanium carbides.

8. The manufacturing method according to claim 7, wherein the insert has a flat frustoconical shape.

9. The manufacturing method according to claim 7, wherein the mixture of compacted powders of titanium and carbon comprises a powder of a ferrous alloy.

10. The manufacturing method according to claim 7, wherein the carbon is graphite.

11. The manufacturing method according to claim 7, wherein the insert is produced by molding or by confinement.

12. The tooth according to claim 1, wherein the insert is at least partially hollow and has a flat frustoconical shape.

13. The tooth according to claim 1, wherein the macro-microstructure generated by the insert is at least 3 mm from a distal surface of the tooth.

14. A composite tooth for working the ground or rocks, the tooth comprising:

a ferrous alloy having a portion reinforced at least partially by an insert comprising an alternating macro-microstructure obtained by in situ reaction, wherein the alternating macro-microstructure comprises millimetric areas concentrated with micrometric globular particles of titanium carbides separated by millimetric areas substantially free of micrometric globular particles of titanium carbides;

wherein the millimetric areas concentrated with micrometric globular particles of titanium carbides form a microstructure in which micrometric interstices between the globular particles are also filled by the ferrous alloy of the tooth;

wherein the macro-microstructure of the insert is at least 2 mm from a distal surface of the tooth; and wherein the insert is in the form of a hollow cone including two or more tunnels extending longitudinally through the hollow cone.

* * * * *